US011261383B2

(12) United States Patent
Van Der Merwe et al.

(10) Patent No.: US 11,261,383 B2
(45) Date of Patent: Mar. 1, 2022

(54) ENHANCED TEMPERATURE CONTROL OF BITUMEN FROTH TREATMENT PROCESS

(71) Applicant: Fort Hills Energy L.P., Calgary (CA)

(72) Inventors: Shawn Van Der Merwe, Calgary (CA); Thomas Hann, Onoway (CA)

(73) Assignee: Fort Hills Energy L.P., Calgary (CA)

( * ) Notice: Subject to any disclaimer, the term of this patent is extended or adjusted under 35 U.S.C. 154(b) by 113 days.

(21) Appl. No.: 16/597,340

(22) Filed: Oct. 9, 2019

(65) Prior Publication Data

US 2020/0048560 A1 Feb. 13, 2020

Related U.S. Application Data

(63) Continuation of application No. 14/114,859, filed as application No. PCT/CA2012/050286 on May 2, 2012, now abandoned.

(30) Foreign Application Priority Data

May 18, 2011 (CA) ..... 2740935

(51) Int. Cl.
*C10G 1/04* (2006.01)
*C10G 33/00* (2006.01)

(52) U.S. Cl.
CPC ..... *C10G 1/04* (2013.01); *C10G 1/047* (2013.01); *C10G 33/00* (2013.01); *C10G 2300/1033* (2013.01)

(58) Field of Classification Search
CPC ..... C10G 1/04; C10G 1/045; C10G 1/047; C10G 33/00; C10G 33/08; C10G 2300/1033
See application file for complete search history.

(56) References Cited

U.S. PATENT DOCUMENTS 1,816,680 A 8/1876 Gregg et al.
1,085,135 A 1/1914 Kelly et al.
(Continued)

FOREIGN PATENT DOCUMENTS

CA 918091 A1 1/1973
CA 918588 A1 1/1973
(Continued)

OTHER PUBLICATIONS

Mitchell et al. "The solubility of asphaltenes in hydrocarbon solvents" Fuel, 1973, N. 02, vol. 52, p. 149-152 [Cited in related U.S. Appl. No. 14/114,859].
(Continued)

*Primary Examiner* — Prem C Singh
*Assistant Examiner* — Brandi M Doyle
(74) *Attorney, Agent, or Firm* — BakerHostetler

(57) ABSTRACT

A method for pre-treating bitumen froth for mixing with solvent for froth treatment includes heating the froth to a froth-solvent mixing temperature below the solvent flash temperature and suitably high to provide reduced bitumen viscosity sufficiently low for complete mixing of the solvent and the froth prior to introduction into a separation apparatus. A method of improving energy use in froth treatment includes reducing heat provided to the solvent, increasing heat provided to the froth prior to adding the solvent to reduce bitumen viscosity and adding the temperature-reduced solvent to the heated froth. A froth treatment separation process includes trim heating first and second solvent streams to adjust the first and second stage separation temperatures.

20 Claims, 5 Drawing Sheets

(56) References Cited

U.S. PATENT DOCUMENTS 1,147,356 A 7/1915 Allen et al.
1,159,044 A 11/1915 Kelly et al.
1,201,558 A 10/1916 Cobb et al.
1,254,562 A 1/1918 Allen et al.
1,261,671 A 4/1918 Zachert et al.
1,494,375 A 5/1924 Reilly et al.
1,754,119 A 4/1930 Frank et al.
1,777,535 A 10/1930 Walcott et al.
2,010,008 A 8/1935 Bray et al.
2,047,989 A 7/1936 William et al.
2,091,078 A 8/1937 Mckittrick et al.
2,111,717 A 3/1938 Rex et al.
2,188,013 A 1/1940 Stanislaw et al.
2,240,008 A 4/1941 Atwell et al.
2,410,483 A 11/1946 Dons et al.
2,853,426 A 9/1958 Peet et al.
2,868,714 A 1/1959 Gilmore et al.
3,081,823 A 3/1963 Constantikes et al.
3,220,193 A 11/1965 Strohmeyer et al.
3,271,293 A 9/1966 Lincoln et al.
3,278,415 A 10/1966 Doberenz et al.
3,291,569 A 12/1966 Joseph et al.
3,575,842 A 4/1971 Simpson et al.
3,705,491 A 12/1972 Foster-pegg et al.
3,779,902 A 12/1973 Mitchell et al.
3,808,120 A 4/1974 Smith
3,901,791 A 8/1975 Baillie
3,929,625 A 12/1975 Lucas
3,954,414 A 5/1976 Samson, Jr. et al.
3,957,655 A 5/1976 Barefoot
4,013,542 A 3/1977 Gudelis et al.
4,035,282 A 7/1977 Stuchberry et al.
4,115,241 A 9/1978 Harrison et al.
4,116,809 A 9/1978 Kizior
4,120,775 A 10/1978 Murray et al.
4,140,620 A 2/1979 Paulett
4,209,422 A 6/1980 Zimmerman et al.
4,210,820 A 7/1980 Wittig
4,230,467 A 10/1980 Buchwald et al.
4,251,627 A 2/1981 Calamur
4,284,242 A 8/1981 Randell
4,314,974 A 2/1982 Libby et al.
4,315,815 A 2/1982 Gearhart
4,321,147 A 3/1982 McCoy et al.
4,324,652 A 4/1982 Hack
4,342,657 A 8/1982 Blair, Jr.
4,346,560 A 8/1982 Rapier
4,395,330 A 7/1983 Auboir et al.
4,410,417 A 10/1983 Miller et al.
4,425,227 A 1/1984 Smith
4,461,696 A 7/1984 Bock et al.
4,470,899 A 9/1984 Miller et al.
4,495,057 A 1/1985 Amirijafar et al.
4,514,305 A 4/1985 Filby
4,518,479 A 5/1985 Schweigharett et al.
4,532,024 A 7/1985 Haschke et al.
4,539,093 A 9/1985 Friedman et al.
4,545,892 A 10/1985 Cymbalisty et al.
4,572,781 A 2/1986 Krasuk et al.
4,584,087 A 4/1986 Peck
4,609,455 A 9/1986 Weimer et al.
4,634,520 A 1/1987 Angelov et al.
4,640,767 A 2/1987 Zajic et al.
4,644,974 A 2/1987 Zingg
4,648,964 A 3/1987 Leto et al.
4,678,558 A 7/1987 Belluteau et al.
4,722,782 A 2/1988 Graham et al.
4,726,759 A 2/1988 Wegener
4,781,819 A 11/1988 Chirinos et al.
4,802,975 A 2/1989 Mehlberg
4,822,481 A 4/1989 Taylor
4,828,688 A 5/1989 Corti et al.
4,859,317 A 8/1989 Shelfantook et al.
4,888,108 A 12/1989 Farnand
4,906,355 A 3/1990 Lechnick et al.
4,929,341 A 5/1990 Thirumalachar et al.
4,931,072 A 6/1990 Striedieck
4,950,363 A 8/1990 Silvey
4,966,685 A 10/1990 Hall et al.
4,968,413 A 11/1990 Datta et al.
5,022,983 A 6/1991 Myers et al.
5,039,227 A 8/1991 Leung et al.
5,133,837 A 7/1992 Elmore et al.
5,143,598 A 9/1992 Graham et al.
5,186,820 A 2/1993 Schultz et al.
5,223,148 A 6/1993 Tipman et al.
5,236,577 A 8/1993 Tipman et al.
5,264,118 A 11/1993 Cymerman et al.
5,282,984 A 2/1994 Ashrawi
5,298,167 A 3/1994 Arnold
5,443,046 A 8/1995 White
5,558,768 A 9/1996 Ikura et al.
5,645,714 A 7/1997 Strand et al.
5,690,811 A 11/1997 Davis et al.
5,817,398 A 10/1998 Hollander
5,871,634 A 2/1999 Wiehe et al.
5,876,592 A 3/1999 Tipman et al.
5,879,540 A 3/1999 Zinke et al.
5,914,010 A 6/1999 Hood et al.
5,937,817 A 8/1999 Schanz et al.
5,948,241 A 9/1999 Owen
5,954,277 A 9/1999 Maciejewski et al.
5,968,349 A 10/1999 Duyvesteyn et al.
5,985,138 A 11/1999 Humphreys
5,988,198 A 11/1999 Neiman et al.
5,997,723 A 12/1999 Wiehe et al.
6,004,455 A 12/1999 Rendall
6,007,708 A 12/1999 Allcock et al.
6,007,709 A 12/1999 Duyvesteyn et al.
6,019,888 A 2/2000 Mishra et al.
6,036,748 A 3/2000 Wallace et al.
6,076,753 A 6/2000 Maciejewski et al.
6,110,359 A 8/2000 Davis et al.
6,120,678 A 9/2000 Stephenson et al.
6,159,442 A 12/2000 Thumm et al.
6,214,213 B1 4/2001 Tipman et al.
6,355,159 B1 3/2002 Myers et al.
6,358,403 B1 3/2002 Brown et al.
6,361,025 B1 3/2002 Cincotta et al.
6,391,190 B1 5/2002 Spence et al.
6,482,250 B1 11/2002 Williams et al.
6,497,813 B2 12/2002 Ackerson et al.
6,523,573 B2 2/2003 Robison et al.
6,549,650 B1 4/2003 Ishikawa et al.
6,566,410 B1 5/2003 Zaki et al.
6,746,599 B2 6/2004 Cymerman et al.
6,800,116 B2 10/2004 Stevens et al.
7,152,851 B2 12/2006 Cincotta
7,357,857 B2 4/2008 Hart et al.
7,569,137 B2 8/2009 Hyndman et al.
7,690,445 B2 4/2010 Perez-Cordova
7,749,378 B2 7/2010 Iqbal et al.
7,820,031 B2 10/2010 D'Alessandro et al.
7,909,989 B2 3/2011 Duyvesteyn et al.
7,934,549 B2 5/2011 Cimolai
8,133,316 B2 3/2012 Poncelet et al.
8,141,636 B2 3/2012 Speirs et al.
8,147,682 B2 4/2012 Lahaie et al.
8,157,003 B2 4/2012 Hackett et al.
8,252,107 B2 8/2012 Esmaeili et al.
8,261,831 B2 9/2012 Lockhart et al.
8,262,865 B2 9/2012 Sharma et al.
8,312,928 B2 11/2012 Lockhart et al.
8,343,337 B2 1/2013 Moffett et al.
8,354,020 B2 1/2013 Sharma et al.
8,357,291 B2 1/2013 Sury et al.
8,382,976 B2 2/2013 Moran et al.
8,394,180 B2 3/2013 Diaz et al.
8,449,764 B2 5/2013 Chakrabarty et al.
8,454,821 B2 6/2013 Chakrabarty et al.
8,455,405 B2 6/2013 Chakrabarty
8,550,258 B2 10/2013 Bara et al.
8,585,892 B2 11/2013 Robertson et al.
2002/0043579 A1 4/2002 Scheybeler

(56) References Cited

U.S. PATENT DOCUMENTS

2003/0089636 A1 5/2003 Marchionna et al.
2004/0074845 A1 4/2004 Hagino et al.
2004/0256325 A1 12/2004 Frankiewicz et al.
2005/0150816 A1* 7/2005 Gaston ..... C10G 1/02 208/39
2005/0150844 A1 7/2005 Hyndman et al.
2006/0065869 A1 3/2006 Chipman et al.
2006/0138055 A1 6/2006 Gamer et al.
2006/0196812 A1 9/2006 Beetge et al.
2007/0125719 A1 6/2007 Yarbrough et al.
2007/0180741 A1 8/2007 Bjornson et al.
2007/0284283 A1 12/2007 Duyvesteyn et al.
2008/0000810 A1 1/2008 Gamer et al.
2008/0185350 A1 8/2008 Remesat et al.
2008/0210602 A1 9/2008 Duyvesteyn
2009/0134059 A1 5/2009 Myers et al.
2009/0200210 A1 8/2009 Hommema
2009/0200688 A1 8/2009 Cincotta
2009/0294328 A1 12/2009 Iqbal
2009/0321322 A1 12/2009 Sharma et al.
2009/0321324 A1 12/2009 Sharma et al.
2010/0006474 A1 1/2010 Gaston et al.
2010/0076236 A1 3/2010 Van Heuzen et al.
2010/0078306 A1 4/2010 Alhazmy
2010/0089800 A1 4/2010 Macdonald et al.
2010/0096297 A1 4/2010 Stevens et al.
2010/0126395 A1 5/2010 Gauthier
2010/0126906 A1 5/2010 Sury
2010/0133149 A1 6/2010 O'connor et al.
2010/0147516 A1 6/2010 Petzer-Zilevitch
2010/0155293 A1 6/2010 Verstraete et al.
2010/0155304 A1 6/2010 Ding et al.
2010/0206772 A1 8/2010 Keppers
2010/0243534 A1 9/2010 Ng et al.
2010/0258477 A1 10/2010 Kukkonen et al.
2010/0258478 A1 10/2010 Moran et al.
2010/0264068 A1 10/2010 Ikebe et al.
2010/0276341 A1 11/2010 Speirs et al.
2010/0276983 A1 11/2010 Dunn et al.
2010/0282642 A1 11/2010 Kan
2010/0298173 A1 11/2010 Smith et al.
2010/0320133 A1 12/2010 Page et al.
2011/0005750 A1 1/2011 Borseth et al.
2011/0011769 A1 1/2011 Sutton et al.
2011/0061610 A1 3/2011 Speirs et al.
2011/0062090 A1 3/2011 Bara et al.
2011/0089013 A1 4/2011 Sakurai et al.
2011/0100931 A1 5/2011 Lake et al.
2011/0127197 A1 6/2011 Blackboum et al.
2011/0146164 A1 6/2011 Haney et al.
2011/0174683 A1 7/2011 Cui et al.
2011/0219680 A1 9/2011 Wilkomirsky Fuica
2011/0233115 A1 9/2011 Moran et al.
2011/0265558 A1 11/2011 Feimer et al.
2011/0284428 A1 11/2011 Adeyinka et al.
2012/0000830 A1 1/2012 Monaghan et al.
2012/0000831 A1* 1/2012 Moran ..... C10G 1/045 208/390
2012/0029259 A1 2/2012 McFarlane et al.
2012/0043178 A1 2/2012 Kan
2012/0074044 A1 3/2012 Mcfarlane
2012/0074045 A1 3/2012 Stauffer
2012/0145604 A1 6/2012 Wen
2012/0175315 A1 7/2012 Revington et al.
2012/0217187 A1 8/2012 Sharma et al.
2012/0288419 A1 11/2012 Esmaeili et al.
2013/0043165 A1 2/2013 Revington et al.
2013/0081298 A1 4/2013 Bugg et al.
2013/0140249 A1 6/2013 Sury et al.
2013/0168294 A1 7/2013 Chakrabarty et al.
2013/0313886 A1 11/2013 Van Der Merwe et al.
2013/0345485 A1 12/2013 Duerr et al.
2014/0001101 A1 1/2014 Van Der Merwe et al.
2014/0011147 A1 1/2014 Van Der Merwe
2014/0048408 A1 2/2014 Van Der Merwe et al.
2014/0048450 A1 2/2014 Van Der Merwe et al.
2014/0076785 A1 3/2014 Penner et al.
2014/0083911 A1 3/2014 Van Der Merwe et al.

FOREIGN PATENT DOCUMENTS

CA 1027501 A 3/1978
CA 1055868 A 6/1979
CA 1059052 A 7/1979
CA 1072474 A 2/1980
CA 1081641 A 7/1980
CA 1111782 A 11/1981
CA 1165712 A 4/1984
CA 1237689 A 6/1988
CA 1245990 A 12/1988
CA 1247550 A 12/1988
CA 1249414 A 1/1989
CA 1263331 A 11/1989
CA 1267860 A 4/1990
CA 1272975 A 8/1990
CA 2012305 A1 9/1990
CA 2029795 A1 5/1991
CA 1291957 C 11/1991
CA 1293465 C 12/1991
CA 2021185 A1 1/1992
CA 2053016 A1 5/1992
CA 2053086 A1 4/1993
CA 2055213 A1 5/1993
CA 2075108 A1 1/1994
CA 2098656 A1 12/1994
CA 2123076 A1 11/1995
CA 2174801 A1 10/1996
CA 2149737 A1 11/1996
CA 2165865 A1 6/1997
CA 2188064 A1 4/1998
CA 2191517 A1 5/1998
CA 2195604 A1 7/1998
CA 2200899 A1 9/1998
CA 2232929 A1 9/1998
CA 2217300 A1 3/1999
CA 2254048 A1 5/1999
CA 2350907 A1 5/2000
CA 2272045 A1 11/2000
CA 2304972 A1 10/2001
CA 2350001 A1 12/2002
CA 2353109 A1 1/2003
CA 2387257 A1 11/2003
CA 2527058 A1 3/2004
CA 2425840 A1 10/2004
CA 2454942 A1 7/2005
CA 2455011 A1 7/2005
CA 2726122 A1 7/2005
CA 2750837 A1 7/2005
CA 2750845 A1 7/2005
CA 2750934 A1 7/2005
CA 2750936 A1 7/2005
CA 2750995 A1 7/2005
CA 2751587 A1 7/2005
CA 2751773 A1 7/2005
CA 2799354 A1 7/2005
CA 2799400 A1 7/2005
CA 2799739 A1 7/2005
CA 2520943 A1 4/2006
CA 2490734 A1 6/2006
CA 2502329 A1 9/2006
CA 2521248 A1 3/2007
CA 2524110 A1 4/2007
CA 2526336 A1 5/2007
CA 2567185 A1 4/2008
CA 2610122 A1 5/2008
CA 2610124 A1 5/2008
CA 2573633 A1 7/2008
CA 2673961 A1 7/2008
CA 2582059 A1 9/2008
CA 2588043 A1 11/2008
CA 2606312 A1 4/2009
CA 2610052 A1 5/2009
CA 2616036 A1 6/2009
CA 2654611 A1 8/2009

(56) References Cited

FOREIGN PATENT DOCUMENTS

| | | | |
|---|---|---|---|
| CA | 2630392 | A1 | 11/2009 |
| CA | 2669059 | A1 | 12/2009 |
| CA | 2638120 | A1 | 1/2010 |
| CA | 2673981 | A1 | 1/2010 |
| CA | 2673982 | A1 | 1/2010 |
| CA | 2641294 | A1 | 4/2010 |
| CA | 2655852 | A1 | 4/2010 |
| CA | 2683374 | A1 | 4/2010 |
| CA | 2643893 | A1 | 5/2010 |
| CA | 2647855 | A1 | 7/2010 |
| CA | 2649928 | A1 | 7/2010 |
| CA | 2652355 | A1 | 8/2010 |
| CA | 2653032 | A1 | 8/2010 |
| CA | 2653058 | A1 | 8/2010 |
| CA | 2689684 | A1 | 8/2010 |
| CA | 2657360 | A1 | 9/2010 |
| CA | 2657801 | A1 | 10/2010 |
| CA | 2661579 | A1 | 10/2010 |
| CA | 2711136 | A1 | 10/2010 |
| CA | 2666025 | A1 | 11/2010 |
| CA | 2708416 | A1 | 12/2010 |
| CA | 2674246 | A1 | 1/2011 |
| CA | 2708048 | A1 | 1/2011 |
| CA | 2678818 | A1 | 3/2011 |
| CA | 2701317 | A1 | 3/2011 |
| CA | 2717406 | A1 | 4/2011 |
| CA | 2729457 | A1 | 7/2011 |
| CA | 2733862 | A1 | 7/2011 |
| CA | 2705055 | A1 | 11/2011 |
| CA | 2768852 | A1 | 11/2011 |
| CA | 2748477 | A1 | 3/2012 |
| CA | 2752558 | A1 | 3/2012 |
| CA | 2730467 | A1 | 8/2012 |
| CA | 2735311 | A1 | 9/2012 |
| CA | 2737410 | A1 | 10/2012 |
| CN | 1187300 | A | 7/1998 |
| EP | 0059106 | A2 | 9/1982 |
| GB | 587798 | A | 5/1947 |
| GB | 2044796 | A | 10/1980 |
| GB | 2145730 | A | 4/1985 |
| JP | S56150407 | A | 11/1981 |
| JP | S57200402 | A | 12/1982 |
| JP | S6285415 | U | 5/1987 |
| RU | 2065455 | C1 | 8/1996 |
| RU | 2078095 | C1 | 4/1997 |
| RU | 2096438 | C1 | 11/1997 |
| WO | 2007102819 | A1 | 9/2007 |
| WO | 2009111871 | A1 | 9/2009 |
| WO | 2010088388 | A1 | 8/2010 |

OTHER PUBLICATIONS

Kemp, "Pinch Analysis and Process Integration, A User Guide on Process Integration for the Efficient Use of Energy", Second edition, Elsevier 2007 [Cited in related U.S. Appl. No. 14/114,859].

Svreck et al. "Successfully Specify Three-Phase Separators" Chemical Engineering Progress, Sep. 1994, p. 29-40 [Cited in related U.S. Appl. No. 14/114,859].

Rahimi et al., "Partial Upgrading of Athabasca Bitumen Froth by Asphaltene Removal", Unitar International Conference on Heavy Crude and Tar Sands, No. 1998.074, p. 1-8 [Cited in related U.S. Appl. No. 14/114,859].

Svreck et al. "Design Two-Phase Separators within the Right Limits" Chemical Engineering Progress, Oct. 1993, p. 53-60 [Cited in related U.S. Appl. No. 14/114,859].

Fu et al. "New technique for determination of diffusivities of volatile hydrocarbons in semi-solid bitumen", Fuel, 1979, vol. 58, August, pp. 557-560 [Cited in related U.S. Appl. No. 14/114,859].

Kamoun et al. "High Speed Shadowgraphy Investigations of Superheated Liquid Jet Atomization", IL.ASS-Americas 22nd Annual Conference on Liquid Atomization and Spray Systems, Cincinnati Ohio, May 2010 [Cited in related U.S. Appl. No. 14/114,859].

Duan et al.s "Numerical Analyses of Flashing Jet Structure and Droplet Size Characteristics" Journal of Nuclear Science and Technology, 2006, vol. 43, No. 3, p. 285-294 [Cited in related U.S. Appl. No. 14/114,859].

Sou et al., "Effects of Cavitation in a Nozzle on liquid Jet atomization" International Journal of Heat and Mass Transfer; vol. 50, p. 3575-3582,2007 [Cited in related U.S. Appl. No. 14/114,859].

Ransom et al., "The relaps choke flow model and application to a large scale flow test", The American Society of Mechanical Engineers, Heat Transfer Division, 1980, Saratoga, New York [Cited in related U.S. Appl. No. 14/114,859].

Power, "Froth Treatment: Past, Present Future" Oil Sand Symposium, University of Alberta, May 3-5, 2004 [Cited in related U.S. Appl. No. 14/114,859].

Rahmani, "Shear-Induced Growth of Asphaltene Aggregates" Oil Sand Symposium, University of Alberta, May 4, 2004 [Cited in related U.S. Appl. No. 14/114,859].

Paul et al. "Handbook of Industrial Mixing: Science and Practice" Wiley Interscience 2004, p. 391-477 [Cited in related U.S. Appl. No. 14/114,859].

Blevins "Applied fluid dynamics handbook", Van Nostrand Reinhold Company 1984, p. 80-83 [Cited in related U.S. Appl. No. 14/114,859].

Wu et al., "Experimental study on steam plume and temperature distribution for sonic jet" J. Phys.: Conf. Ser. 147 2009, 012079 [Cited in related U.S. Appl. No. 14/114,859].

Yeon et al., An Experimental Investigation of Direct Condensation of Steam Jet in Subcooled Water Journal of—Korean Nuclear Society vol. 29, No. 1, pp. 45-57, Feb. 1997 [Cited in related U.S. Appl. No. 14/114,859].

Long et al., "Structure of water/solids/asphaltenes aggregates and effect of mixing temperature on settling rate in solvent-diluted bitumen" Fuel 2004, vol. 83, pp. 823-832 [Cited in related U.S. Appl. No. 14/114,859].

Hoehenberger, Water Treatment, Cycle Chemistry, Boiler Operation and Related Problems/Failures on Steam Generator Systems 30 bar, TOV SOD Industry Services, 2006, p. 1-14 [Cited in related U.S. Appl. No. 14/114,859].

Schroyer, "Understand the Basics of Steam Injection Heating", Chemical Engineering Progress, Hydro-Thermal Corporation, May 1997, p. 1-4 [Cited in related U.S. Appl. No. 14/114,859].

Prosonix, "PSX Steam Jet Diffuser . . . Technology That Makes a Difference", PSX Jet Diffuser [Cited in related U.S. Appl. No. 14/114,859].

Prosonix, "ProSonix Technical Bulletin", TB-4 Liquid Steam Pressure Relationship [Cited in related U.S. Appl. No. 14/114,859].

Prosonix, "PSX Technical Bulletin", TB-7 Internally Modulated Steam Control 0210 [Cited in related U.S. Appl. No. 14/114,859].

Prosonix, "Sparging Efficiency vs. Direct Steam Injection", TB-6 Sparging Efficiency Performance 20101210 [Cited n related U.S. Appl. No. 14/114,859].

Siemens, "Pictures of the Future", Spring 2006, Power Plants—Siemens Global Website,http://www.siemens.com/innovation/en/publikationen/publications_pof/pof_spring_2006/infrastructures_articles/power_plants.htm [Cited in related U.S. Appl. No. 14/114,859].

George, "Mining for Oil", Scientific American, Mar. 1998, p. 84-85 [Cited in related U.S. Appl. No. 14/114,859].

Jeribi et al., "Adsorption Kinetics of Asphaltenes at Liquid Interfaces", Journal of Colloid and Interface Science, vol. 256, Issue 2, Dec. 15, 2002, pp. 268-272 [Cited in related U.S. Appl. No. 14/114,859].

Branan, "Pocket Guide to Chemical Engineering" Elsevier Science Technology Books, Nov. 1999 [Cited in related U.S. Appl. No. 14/114,859].

Perry, "Perrys Chemical Engineers Handbook" (7th Ed.), 1997 [Cited in related U.S. Appl. No. 14/114,859].

Clarke et al., "Asphaltenes precipitation from Cold Lake and Athabasca bitumens", Petroleum Science and Technology, 1998, 16:3-4, p. 287-305 [Cited in related U.S. Appl. No. 14/114,859].

Al-Atar, "Effect of Oil Compatibility and Resins/Asphaltenes Ratio on Heat Exchanger Fouling of Mixtures Containing Heavy Oil", Master Degree Thesis report, The University of British Columbia, Feb. 2000 [Cited in related U.S. Appl. No. 14/114,859].

(56) References Cited

OTHER PUBLICATIONS

Gearhart, "Rose® process offers energy savings for solvent extraction", Proceedings from the Fifth Industrial Energy Technology Conference vol. II, Houston, TX, Apr. 17-20, 1983, p. 823-835 [Cited in related U.S. Appl. No. 14/114,859].
Clarke et al., "Asphaltene precipitation: detection using heat transfer analysis, and inhibition using chemical additives" Fuel, vol. 78, Issue 7, May 1997, p. 607-614 [Cited in related U.S. Appl. No. 14/114,859].
Shell Canada Limited, Application for Approval of the Jackpine Mine- Phase 1, ERCB application No. 1271285, May 2002 [Cited in related U.S. Appl. No. 14/114,859].
Mperial Oil Ressources Ventures Limited, Application for the Imperial Oil Resources Ventures Limited Imperial Oil) and ExxonMobil Canada Properties (ExxonMobil Canada) Kearl Oil Sands Project—Mine Development (Kearl Project), ERCB Application No. 1408771, Jul. 12, 2005 [Cited in related U.S. Appl. No. 14/114,859].
Shell Canada Limited, Application for the Approval of Muskeg River Mine Project, ERCB Application No. 970588, Dec. 19, 1997 [Cited in related U.S. Appl. No. 14/114,859].
Beckman Coulter, Particle Size and Size Distribution Analysis, Coulter Counter.com, pp. 1-3 [Cited in related U.S. Appl. No. 14/114,859].
Outokumpu Technology, Slurry particle size analyzer, PSI 200 TM, 2006, pp. 1-8 [Cited in related U.S. Appl. No. 14/114,859].
Johnson, Particle size distribution in clays, Clays and Clay Minerals, pp. 89-91 [Cited in related U.S. Appl. No. 14/114,859].
Buckley et al., Solubility of the Least-Soluble Asphaltenes, Asphaltenes, Heavy Oils, and Petroleomics, Springer, 2007, Chapter 16, pp. 401-437 [Cited in related U.S. Appl. No. 14/114,859].
Gerson et al., The Relation of Surfactant Properties to the Extraction of Bitumen from Athabasca Tar Sand by a Solvent-Aqueous-Surfactant Process, Chemistry for Energy, American Chemical Society, 1979, Chapter 6, pp. 66-79 [Cited in related U.S. Appl. No. 14/114,859].
Nour et al., Characterization and Demulsification of Water-in-crude Oil Emulsions, Journal of Applied Sciences, vol. 7, issue 10, 2007, pp. 1437-1441 [Cited in related U.S. Appl. No. 14/114,859].
Malcolmson et al., In-Line Particle Size Measurements for Cement and Other Abrasive Process Environments, for Presentation at the IEEE/PCA 40th Cement Industry Technical Conference, 1998, pp. 1-13 [Cited in related U.S. Appl. No. 14/114,859].
Bui et al., "Modelling of Viscous Resuspension Using a One-Field Description of Multiphase Flows", Third International Conference on CFD in the Minerals and Process Industries, 2003 pp. 265-268 [Cited in related U.S. Appl. No. 14/114,859].
Dispersion Technology, Inc., Model DT-1201 ... Acoustic and electro-acoustic spectrometer, Particle size and zeta potential measurement [Cited in related U.S. Appl. No. 14/114,859].
Csiro Minerals, UltraPS—Ultrasonic Particle Size Analyser, www.minerals.csiro.au [Cited in related U.S. Appl. No. 14/114,859].
Wedd, "Determination of Particle Size Distributions Using Laser Diffraction", Educ. Reso. for Part. Techn. 032Q-Wedd, pp. 1-4 [Cited in related U.S. Appl. No. 14/114,859].
Rahmani et al., "Settling Properties of Asphaltene Aggregates", Abstract, Energy Fuels, 2005, 19 (3), pp. 1099-1108 [Cited in related U.S. Appl. No. 14/114,859].
Rahmani et al., "Fractal structure of asphaltene aggregates", Abstract, Journal of Colloid and Interface Science, 6 vol. 285, Issue 2, May 15, 2005, pp. 599-608 [Cited in related U.S. Appl. No. 14/114,859].
A John Brooks Website, Spraying pumping filtering, Automated Retractable Nozzle System, FluidHandlingSolutions. com [Cited in related U.S. Appl. No. 14/114,859].
Liang et al., "Experimental and Analytical Study of Direct Contact Condensation of Steam in Water" Nucl. Eng. Des., 147, Issue 3, Apr. 1994, pp. 425-435 [Cited in related U.S. Appl. No. 14/114,859].
Peramanu et al., "Flow loop apparatus to study the effect of solvent, temperature and additives on asphaltene precipitation" Journal of Petroleum Science and Engineering, vol. 23, Issue 2, Aug. 1999, pp. 133-143 [Cited in related U.S. Appl. No. 14/114,859].
Baha Abulnaga, Pumping Oil Sand Froth, Proceedings of the Twenty-First International Pump Users Symposium (2004) [Cited in related U.S. Appl. No. 14/114,859].
William L. Luyben, "Heat-Exchanger Bypass Control", Ind, Eng. Chem, Res. 2011, 50, 965-973 [Cited in related U.S. Appl. No. 14/114,859].
Dutta-B, "Principles of Mass Transfer and Separation Processes", p. 344, 2009 [Cited in related U.S. Appl. No. 14/114,859].
Schaschke, Carl (2014). Dictionary of Chemical Engineering, Oxford University Press, p. 67, Online version available at:http:///app.knovel.com/hotlink/toc/id:kpDC E00021 /dictionary-chemical-engineering/dictionary-chemical-engineering [Cited in related U.S. Appl. No. 14/114,859].
Imran Ali, "Process Heating by Direct Steam Injection", Pharmaceutical Guide; Dec. 2010 [Cited in related U.S. Appl. No. 14/114,859].
Choung, J. et al., "Effect of Temperature on the Stability of Froth Formed in the Recycle Process Water of Oil Sands Extraction", The Canadian Journal of Chemical Engineering, vol. 82, Aug. 2004, pp. 801-806 [Cited in related U.S. Appl. No. 14/114,859].
Wiwchar, K. et al., Column Flotation in an Oilsand Application, Proceedings 36th Annual Meeting of Canadian Mineral Processors, Ottawa, Ontario, Canada, Jan. 20-22, 2004 [Cited in related U.S. Appl. No. 14/114,859].
Cleyle, P. et al., "Column Flotation Testing at Suncor Energy Inc.", Oilsand 2006 Conference CD, University of Alberta, Feb. 22-24, 2006 [Cited in related U.S. Appl. No. 14/114,859].
Finch, J. et al. "Column Flotation" 1st ed. Pergamon Press, 1990, pp. 1-7, 75-79, 82-89, 148-149, 152-159 [Cited in related U.S. Appl. No. 14/114,859].
Baczek, "Paste Thickener Designs Evolving to Higher Capacy and Efficiencies", International Minimizing Supplement to Paste Tailing Management, Mar. 2007. 16 pages [Cited in related U.S. Appl. No. 14/114,859].
Versteeg et al., "An Introduction to Computational Fluid Dynamics: the Finite Volumn Method", 2nd Edition, Pearson Prentice Hall, First published 1995 and 2nd Edition published 2007 [Cited in related U.S. Appl. No. 14/114,859].
Ferziger et al., "Computational Methods for Fluid Dynamics", 3rd Edition, Springer, 2002, pp. 142-151, 188-206, 226-245, 280-307, 324-328 [Cited in related U.S. Appl. No. 14/114,859].
Hobbs. D. M., "Optimization of a Static Mixer Using Dynamical Systems Techniques", published 1998, Elsevier Science, Chemical Engineering, vol. 53, No. 18, pp. 3199-3213 [Cited in related U.S. Appl. No. 14/114,859].
Godard, et al., "A Review of Suncor Energys Millennium Extraction Process", Proceedings 36th Annual Meeting of the Canadian Mineral Processors, Ottawa, Ontario, Canada, Jan. 20-22, 2004, pp. 141-152 [Cited in related U.S. Appl. No. 14/114,859].
Mankowski, et al., "Syncrudes Low Energy Extraction Process: Commercial Implementation", The British Library-"The worlds knowledge", pp. 153-181 [Cited in related U.S. Appl. No. 14/114,859].
"Choked Flow of Gases", OKeefe Controls Co., website: www.okcc.com [Cited in related U.S. Appl. No. 14/114,859].
Andrews et al. "Great Canadian Oil Sands Experience in Commercial Processing of Athabasca Tar Sands" American Chemical Society San Francisco Meeting Apr. 2-5, 1968, p. F5-F18 [Cited in related U.S. Appl. No. 14/114,859].

* cited by examiner

ENHANCED TEMPERATURE CONTROL OF BITUMEN FROTH TREATMENT PROCESS

REFERENCE TO RELATED APPLICATIONS

This application is a Continuation of U.S. patent application Ser. No. 14/114,859, filed on Oct. 30, 2013, which is a National Stage of International Application No. PCT/CA2012/050286, filed on May 2, 2012, which claims priority to Canadian Patent Application No. CA 2,740,935, filed on May 18, 2011, the disclosures of which are incorporated by reference in their entirety.

FIELD OF THE INVENTION

The present invention generally relates to the field of oil sands processing and in particular relates to the temperature control methods for enhanced treatment of bitumen froth.

BACKGROUND

Oil sand extraction processes are used to liberate and separate bitumen from oil sand so that the bitumen can be further processed to produce synthetic crude oil. Water extraction processes, such as the "Clark Hot Water Process", involves providing a conditioned oil sand aqueous slurry and then separating the slurry into fractions including an overflow bitumen froth fraction.

Bitumen froth is typically subjected to froth treatment using a solvent as diluent to remove the mineral solids and water from the froth and recover diluted bitumen. Naphthenic and paraffinic solvents have been used for this purpose. In a paraffinic froth treatment (PFT) operation, asphaltenes are precipitated along with water and mineral solids for removal from the bitumen. PFT operations thus reduce the fine solids, asphaltene and water content of the bitumen froth.

In a froth treatment operation, there may be three principal units: a froth separation unit (FSU), a solvent recovery unit (SRU) and a tailings solvent recovery unit (TSRU). In the FSU, solvent is added to the bitumen froth and the resulting mixture may be fed to a multi-stage separation process with at least two separation vessels which may be arranged in a counter-current configuration as disclosed in Canadian patent application No. 2,454,942 (Hyndman et al.). The FSU produces a high diluted bitumen stream and a solvent diluted tailings stream which are respectively treated in the SRU and TSRU to recover solvent for reuse in the FSU.

Some control methods and operational conditions have been proposed in an attempt to improve the separation performance or operational efficiency of froth treatment operations. Hyndman et al. discloses operating an FSU between 70° C. and 90° C. It is also known to provide heat exchangers for generally heating or cooling various streams associated with a PFT operation or for keeping overall units within a particular temperature range. Hyndman et al. also discloses a temperature control technique for a two-stage counter-current FSU. In the two-stage counter-current FSU, there is a first stage settler which is fed diluted froth and produces overflow and underflow components. Fresh solvent is added to the first stage underflow and the resulting stream is fed to a second stage settler which produces a second stage overflow with high solvent content and an underflow of solvent diluted tailings. The second stage overflow is recycled and added into the bitumen froth to produce the first stage diluted froth. Hyndman et al. discloses that by controlling the temperature of solvent added to the first stage underflow, operating temperatures of the first stage settler can be indirectly regulated.

Known techniques for handling temperature and controlling separation performance in froth treatment operations, in particular in the FSU, have had several drawbacks.

Some research identifies that temperature in general influences paraffinic solvent assisted treatment of bitumen froth. One paper entitled "Structure of water/solids/asphaltenes aggregates and effect of mixing temperature on settling rate in solvent-diluted bitumen" Long et al., Fuel Vol. 83, 2004 (hereafter referred to as "Long et al.") identifies that in paraffinic solvent assisted froth treatment, temperature influences water/solids/precipitated-asphaltene aggregate structures and settling of the aggregates. In Long et al., bitumen froth and paraffinic solvent were combined and the mixture was heated to desired temperatures between 30° C. and 120° C., allowed to cool to 30° C. followed by settling.

Bitumen froth quality can range significantly, for instance from 50 wt % to 70 wt % bitumen. In addition, the main components of the froth, which are bitumen, water and minerals, differ significantly in heat capacity. These differences of physical properties can result in variable operating temperatures when the main components are blended with solvent at specific temperature conditions. Since the performance of the separation is temperature sensitive, varying compositions and temperatures translates to varying process performance.

In summary, known practices and techniques for the separation treatment of bitumen froth experience various drawbacks and inefficiencies, and there is indeed a need for a technology that overcomes at least some of those drawbacks and inefficiencies.

SUMMARY OF THE INVENTION

The present invention responds to the above-mentioned need by providing methods and processes for temperature enhanced froth treatment.

More particularly, one embodiment the invention provides a method for pre-treating bitumen containing froth for mixing with a solvent containing stream to produce a diluted froth for introduction into a separation apparatus for separation into a diluted bitumen component and a solvent diluted tailings component, the method comprising heating the bitumen froth to produce a heated froth with a froth-solvent mixing temperature that is below a flash temperature of the solvent and suitably high to provide a reduced bitumen viscosity sufficiently low to allow complete mixing of the solvent and the froth so that the diluted froth is fully mixed prior to introduction thereof into the separation apparatus.

In an optional aspect, the bitumen froth has a bitumen content between about 40 wt % and about 75 wt %.

In another optional aspect, the method includes adapting the heating of the bitumen froth in accordance with the bitumen content thereof.

In another optional aspect, the solvent is selected from paraffinic solvent and naphthenic solvent.

In another optional aspect, the heating is conducted by direct steam injection.

In another optional aspect, the heating is conducted to control the froth-solvent mixing temperature above about 60° C. In another optional aspect, the heating is conducted to control the froth-solvent mixing temperature above about 70° C. In another optional aspect, the heating is conducted to control the froth-solvent mixing temperature above about 90° C. In another optional aspect, the heating is conducted to control the froth-solvent mixing temperature in between about 90° C. and about 120° C.

In another optional aspect, the heating is conducted to cause formation of bitumen droplets having a maximum droplet size $d_{max}$ of at most about 100 □m.

In another optional aspect, the heating is conducted to cause formation of bitumen droplets having a maximum droplet size $d_{max}$ in between about 100 □m and about 25 □m.

In another optional aspect, the heating is conducted to control the reduced bitumen viscosity of at most about 650 cP. In another optional aspect, the heating is conducted to control the reduced bitumen viscosity in between about 100 cP and about 650 cP. In another optional aspect, the heating is conducted to provide the reduced bitumen viscosity between about 1.5 times and about 100 times lower than the viscosity of the bitumen in the froth.

In another optional aspect, the heating is conducted to control the froth-solvent mixing temperature at least about 10° C. below the flash temperature of the solvent.

In another optional aspect, the heating is conducted to reduce a bitumen/solvent viscosity ratio by at least about an order of magnitude.

In another optional aspect, the heating is conducted to control the froth-solvent mixing temperature above a temperature of the solvent, for instance at least about 10° C. above the temperature of the solvent.

In another optional aspect, the separation apparatus comprises a first stage separation vessel and a second stage separation vessel in counter-current configuration. The method may include supplying the diluted froth to the first stage separation vessel and producing the diluted bitumen component and a first stage underflow component; adding a make-up solvent stream to the first stage underflow component to produce a diluted first stage underflow; supplying the diluted first stage underflow to the second stage separation vessel and producing the a second stage overflow component and a second stage underflow component as the solvent diluted tailings component; and supplying the second stage overflow component as the solvent containing stream added to the heated froth.

In another optional aspect, the method includes trim heating the solvent containing stream to control temperatures of the diluted froth and the first stage separation vessel.

In another optional aspect, the method includes trim heating the make-up solvent stream to control temperatures of the diluted first stage underflow to the second stage separation vessel.

In another optional aspect, the method includes maintaining a first operating temperature of the first stage separation vessel above a second operating temperature of the second stage separation vessel.

In another optional aspect, the method includes providing the make-up solvent stream cooler than the solvent containing stream added to the heated froth.

In another optional aspect, the method includes subjecting the solvent diluted tailings component to solvent recovery flashing and operating the second stage separation vessel such that the solvent diluted tailings component has a temperature suitable for the solvent recovery flashing.

In another embodiment, the present invention provides a method of improving energy use in a froth treatment operation, the froth treatment operation comprising adding a solvent containing stream to bitumen froth to produce a diluted froth, introducing the diluted froth into a separation apparatus and producing from the separation apparatus a diluted bitumen component and a solvent diluted tailings component, the method comprising: reducing heat provided to the solvent containing stream thereby producing a temperature-reduced solvent stream; increasing heat provided to the bitumen froth prior to adding the solvent containing stream thereto to produce a heated froth with a froth-solvent mixing temperature that is below a flash temperature of the solvent and suitably high to provide a reduced bitumen viscosity; and adding the temperature-reduced solvent to the heated froth and thereby producing the diluted froth for separation.

This method may have one or more of the optional aspects mentioned herein-above.

In another embodiment, the present invention provides a process for separating a bitumen froth into a diluted bitumen component and a diluted tailings component, the process comprising: adding a first solvent containing stream to the bitumen froth to produce a diluted bitumen froth, the first solvent-containing stream having a first solvent temperature and the bitumen froth having a froth temperature; separating the diluted bitumen froth into a first stage overflow component and a first stage underflow component having an underflow temperature, wherein the first stage overflow component comprises the diluted bitumen component; adding a second solvent containing stream to the first stage underflow component to produce a diluted first stage underflow component, the second solvent containing stream having a second solvent temperature; separating the diluted first stage underflow component into a second stage overflow component and a second stage underflow component, wherein the second stage underflow component comprises the diluted tailings component; trim heating the first solvent containing stream to adjust the first solvent temperature to maintain consistent first stage separation temperature; and trim heating the second solvent containing stream to adjust the second solvent temperature to maintain consistent second stage separation temperature.

This process may have one or more of the optional aspects of the methods mentioned herein-above. In one optional aspect of the process, the froth temperature is at least 65° C., between about 70° C. and about 120° C., or above 90° C. In another optional aspect of the process, the first stage separation temperature is maintained above the second stage separation temperature. The bitumen froth may be preheated before the adding of the first solvent containing stream to the bitumen froth. In another optional aspect of the process, the trim heating of the first and second solvent containing streams are performed with heat exchangers. In further optional aspects of the process, the solvent may be naphthenic or paraffinic solvent.

DETAILED DESCRIPTION

Figure 1:
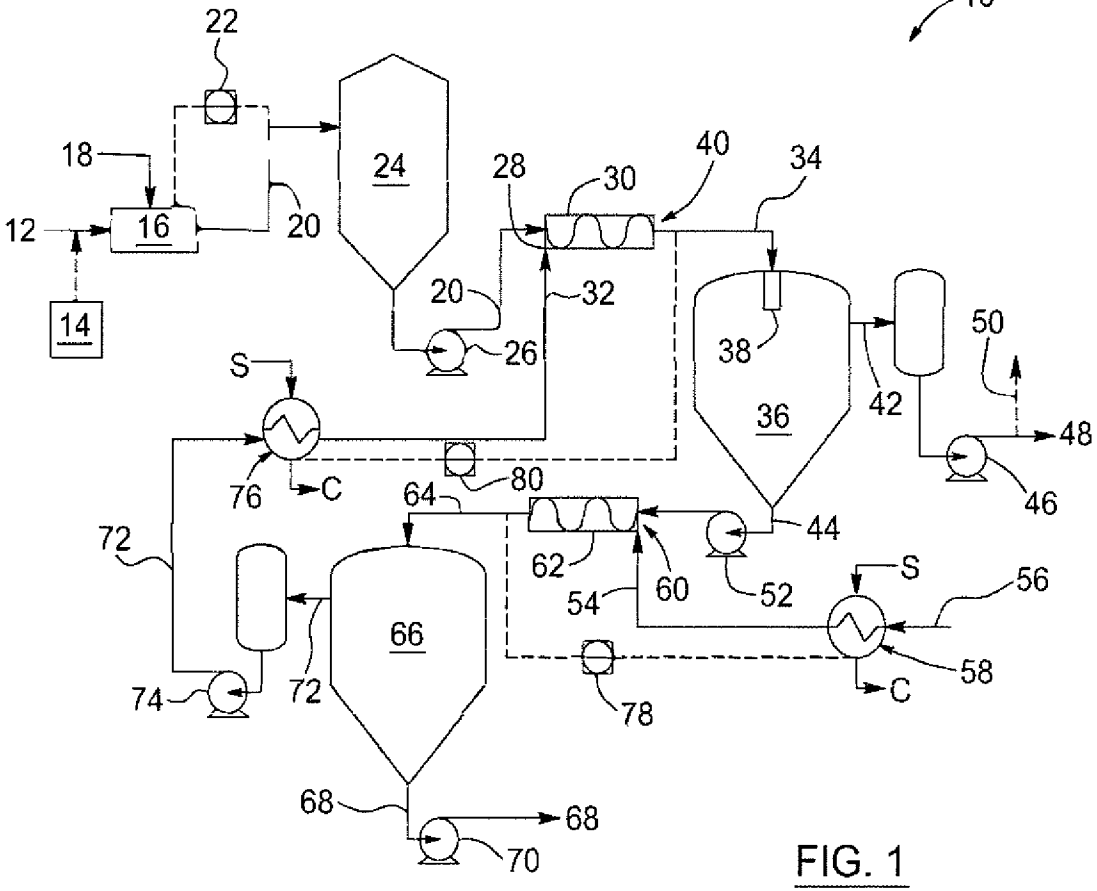
FIG. 1 is a schematic flow diagram according to an embodiment of the present invention.

In one embodiment of the present invention, the bitumen froth is heated to a froth mixing temperature that is below the flash temperature of the solvent and suitably high to reduce the viscosity of the bitumen froth to a froth mixing viscosity sufficiently low to allow complete mixing of the solvent and the bitumen froth to form a fully mixed diluted froth prior to its introduction into the separation vessel. Controlling the temperature of the bitumen froth stream, rather than merely the solvent addition stream, the combined diluted froth stream or the separation vessel, allows improved mixing control and results.

Bitumen froth has a composition ranging between about 50 wt % to about 70 wt % bitumen with the remainder comprising mostly water and mineral solids. The initial bitumen viscosity in froth is often in the range of about 1,000 to about 10,000 centipoise (cP). In contrast, the viscosity of the solvent stream added to the bitumen froth is between about 0.1 and about 1 cP, often around 0.2 cP. Adjusting the solvent temperature thus has a negligible effect on mixing and formation of a properly blended diluted froth. In this regard, it is noted that solvent temperature can have effects on the performance of other process steps, which will be further discussed herein-below. As for the step of mixing the solvent and the bitumen froth, the stream that limits mixing efficacy is the bitumen froth. By controlling the temperature of the bitumen froth as high as possible without exceeding the flash temperature of the solvent, the bitumen froth is rendered susceptible to breaking up into droplets having a sufficiently small diameter to ensure dissolution and reactions with the added solvent and thus the mixing efficacy is enhanced.

In one aspect, the froth mixing temperature is controlled sufficiently low such that the mixing with the solvent in the in-line supply system to the separation vessel achieves a fully mixed diluted froth at the discharge into the separation vessel. The in-line supply system may include one or more mixer, piping including pipe lengths and fittings, valves and other in-line devices or arrangements that may impart mixing energy to the blending diluted bitumen. The froth mixing temperature may be tailored to a given in-line supply system and the other operating conditions such as pressure and flow rate. The froth mixing temperature may also be controlled to vary depending on the bitumen froth composition to achieve the froth mixing viscosity required to achieve the blending in a given in-line supply system. It should thus be understood that FSUs and processes may be adjusted or retrofitted to allow froth mixing temperature control based on existing in-line supply systems. The retrofitting may include addition of froth heaters and temperature control system upstream of the solvent addition point.

In another embodiment of the present invention, the solvent containing streams added to the bitumen containing streams are trim heated to maintain consistent temperature in the first and second stage separation vessels. Maintenance of consistent temperatures in the separation vessels allows improved process control and bitumen recovery over variable froth flows and feed compositions.

Embodiments of the present invention will further be described and elaborated in connection with FIG. 1.

FIG. 1 illustrates an FSU 10 according to an embodiment of the present invention. The FSU 10 is preferably operated in connection with embodiments of the process of the present invention for treating and separating bitumen froth. It should be noted that the bitumen froth treatment process may be paraffinic or naphthenic or may use other mixtures or types of solvents.

The FSU 10 receives bitumen froth 12 from an upstream separation vessel (not illustrated) via pipeline. The bitumen froth 12 may contain a range of bitumen content from about 50 wt % to about 70 wt % with an average of about 60 wt %, for example, and may be measured and characterized to assess a number of variables which may include flow rate, composition, viscosity, density and initial froth temperature which may be used to estimate or calculate additional variables such as heat capacity. One or more measurement devices 14 may be used to ascertain properties of the bitumen froth 12.

In the temperature control scheme for controlling the temperature of the bitumen froth 12, a heater 16 is preferably provided. The heater 16 may include multiple heater sub-units (not illustrated) and is preferably a direct steam injection (DSI) type heater which injects steam 18 directly into the bitumen froth 12 to produce a heated bitumen froth 20. A temperature measurement and control system 22 may be provided for controlling the temperature of the heated bitumen froth 20.

The heater 16 and associated heating step may be provided and operated as described in Canadian patent application No. 2,735,311 (van der Merwe et al.). The heating step for heating bitumen froth with varying heating requirement, may include (a) injecting steam directly into the froth at a steam pressure through a plurality of nozzles, wherein the injecting of the steam and the size and configuration of the nozzles are provided to achieve sonic steam flow; (b) operating the plurality of the nozzles to vary steam injection by varying a number of the nozzles through which the injecting of the steam occurs in response to the variable heating requirements for the froth; and (c) subjecting the froth to backpressure sufficient to enable sub-cooling relative to the boiling point of water.

In one aspect, the heated bitumen froth 20 is supplied to a froth tank 24. Alternatively, the heated bitumen froth 20 may be supplied directly to downstream units. The heated froth 20 is pumped via a froth tank pump 26 toward solvent addition point 28 and mixer 30. The solvent addition point 28 may be part of the mixer 30 or may be immediately upstream of a separate mixer 30. The solvent addition point may be, for example, a pipeline junction such as a tee junction, a co-annular mixing device, or another type of arrangement. A solvent containing stream 32 is thus added to the heated bitumen froth 20 at the solvent addition point 28. Thus, the heated bitumen froth 20 is heated and then mixed with a first solvent-containing stream 32 breaking the bitumen froth into droplets and ensuring mass and heat transfer with the first solvent-containing stream 32. While froth may macroscopically appear to be a homogeneous mixture, at close range the froth fluid comprises discrete droplets, parcels and particles of material. Breaking up the discrete droplets facilitates the hydrocarbons to dissolve. The solvent addition and mixing produce a diluted bitumen froth 34.

The mixer 30 and associated mixing step may be provided and operated as described in Canadian patent application No. 2,733,862 (van der Merwe et al.). The step of adding and mixing solvent with the bitumen froth may include addition, mixing and conditioning performed with particular CoV, Camp number, co-annular pipeline reactor where the solvent is added along the pipe walls, and/or pipe wall contact of lower viscosity fluid.

The diluted bitumen froth 34 is supplied to a first stage separation vessel 36 via a discharge 38 which may extend and be located within the first stage separation vessel 36. It is noted that the solvent and bitumen froth blend and form the diluted bitumen froth 34 within what is referred to herein as an in-line supply system 40, which includes the mixer 30 and all piping, fittings, and in-line devices from the solvent addition point 28 to the discharge 38. The in-line supply system 40 imparts a mixing energy to the blending solvent and froth mixture. In one aspect, the froth temperature controller 22 is managed, operated, designed, calibrated, adjusted to pre-determined to tailor the heating imparted to the bitumen froth 12 so that the temperature of the heated bitumen froth 20 enables a sufficiently low viscosity so that the mixing energy of the in-line supply system 40 is sufficient to produce a fully mixed diluted bitumen froth at least at the discharge 30 into the first stage separation vessel 36. In another preferred aspect, the froth temperature controller 22 tailors the heating so that the temperature of the heated bitumen froth 20 enables a sufficiently low viscosity so that the initial rapid mixing in the given mixer 30 is sufficient to produce a fully mixed diluted bitumen froth flowing out of the mixer 30. The temperature controller 22 may also be coupled and receive information from the measurement devices 14 to adjust the heater 16. For example, the measurement devices 14 may monitor the bitumen content of the froth 12 and the heating may be adjusted to achieve the desired temperature and viscosity in relation to the bitumen content.

In this regard, the heating, mixing and conditioning are coordinated to obtain the diluted froth. Considering the kinetics of mixing the solvent into the bitumen froth, the froth is heated sufficiently such that in the in-line supply system provides sufficient time and conditioning energy to produce the fully mixed diluted bitumen froth at the solvent-bitumen system kinetics. Sufficiently increasing the temperature of the froth causes a viscosity reduction allowing reduced pipeline length and mixing equipment and improving efficiency and performance of control options.

The supplying of the diluted bitumen froth 34 to the separation vessel may also be performed as described in Canadian patent application No. 2,733,862 (van der Merwe et al.). The diluted bitumen froth 34 may be supplied to the vessel with axi-symmetric phase and velocity distribution and/or particular mixing and conditioning features such as flow diffusing and/or flow straightening.

Still referring to FIG. 1, the first stage separation vessel 36 produces a first stage overflow component 42 consisting of diluted bitumen and a first stage underflow component 44 consisting of first stage tailings containing water, mineral solids, residual bitumen and, in paraffinic treatment processes, precipitated asphaltenes in water/solids/precipitated-asphaltene aggregates. The first stage overflow component 42 is pumped via first stage overflow pump 46 for further downstream processing as high diluted bitumen 48. Here it is noted that a portion of the first stage overflow component may be withdrawn as a diltbit recirculation stream 50 for recirculation upstream of the first stage separation vessel 36. For instance, the diltbit recirculation stream 50 may be reintroduced into the bitumen froth 12, the heated bitumen froth 20 upstream or downstream of the froth tank 24 or froth tank pump 26, or the diluted bitumen froth 34, depending on operating parameters and desired effect. In one preferred aspect, the diltbit recirculation stream 50 is reintroduced into the heated bitumen froth 20 in between the froth pump 26 and the mixer 30.

The first stage underflow component 44 is pumped via first stage underflow pump 52 toward a second stage. In the second stage, the first stage underflow component 44 is combined with a second solvent-containing stream 54. The second solvent-containing stream 54 preferably consists essentially of solvent which has been recovered from the SRU and TSRU and also includes fresh make-up solvent. This stream is provided as an unheated solvent stream 56 which is preferably heated in a second stage solvent trim heater 58, which may be a heat exchanger receiving steam S and releasing condensate C. The resulting heated second solvent containing stream 54 is added to the first stage underflow component 44 at a second solvent addition point 60. Like the first addition point 40, the second solvent addition point 60 may be located and arranged in various configurations relative to the other elements of the second stage. A second stage mixer 62 is preferably provided immediately downstream of the second solvent addition point 60. Downstream of the mixer a diluted first stage underflow 64 is supplied to a second stage separation vessel 66 which produces a second stage underflow component 68 which is sent via froth treatment tailings pump 70 to the TSRU as solvent diluted tailings. The second stage separation vessel 66 also produces a second stage overflow component 72 which is pumped via second stage overflow pump 74.

As illustrated, the second stage overflow component 72 contains a significant amount of solvent and is preferably used as the first solvent containing stream 32. The second stage overflow component 72 is withdrawn from the second stage separation vessel 66 at the separation temperature and is preferably heated by a first stage solvent trim heater 76.

In one optional aspect, the solvent trim heaters 58, 76 are regulated to heat the solvent containing streams to a desired temperature to maintain a consistent temperature of the diluted first stage underflow and diluted bitumen froth streams. Thus, trim heating temperature controllers 78, 80 may be used to monitor the temperature of the diluted streams 64, 34 and adjust the trim heating of the solvent accordingly. By providing consistent temperatures for the diluted streams 34, 64 feeding the first and second separation vessels 36, 66, the settling temperature and conditions can be advantageously controlled resulting in improved setting stability and performance.

Figure 2:
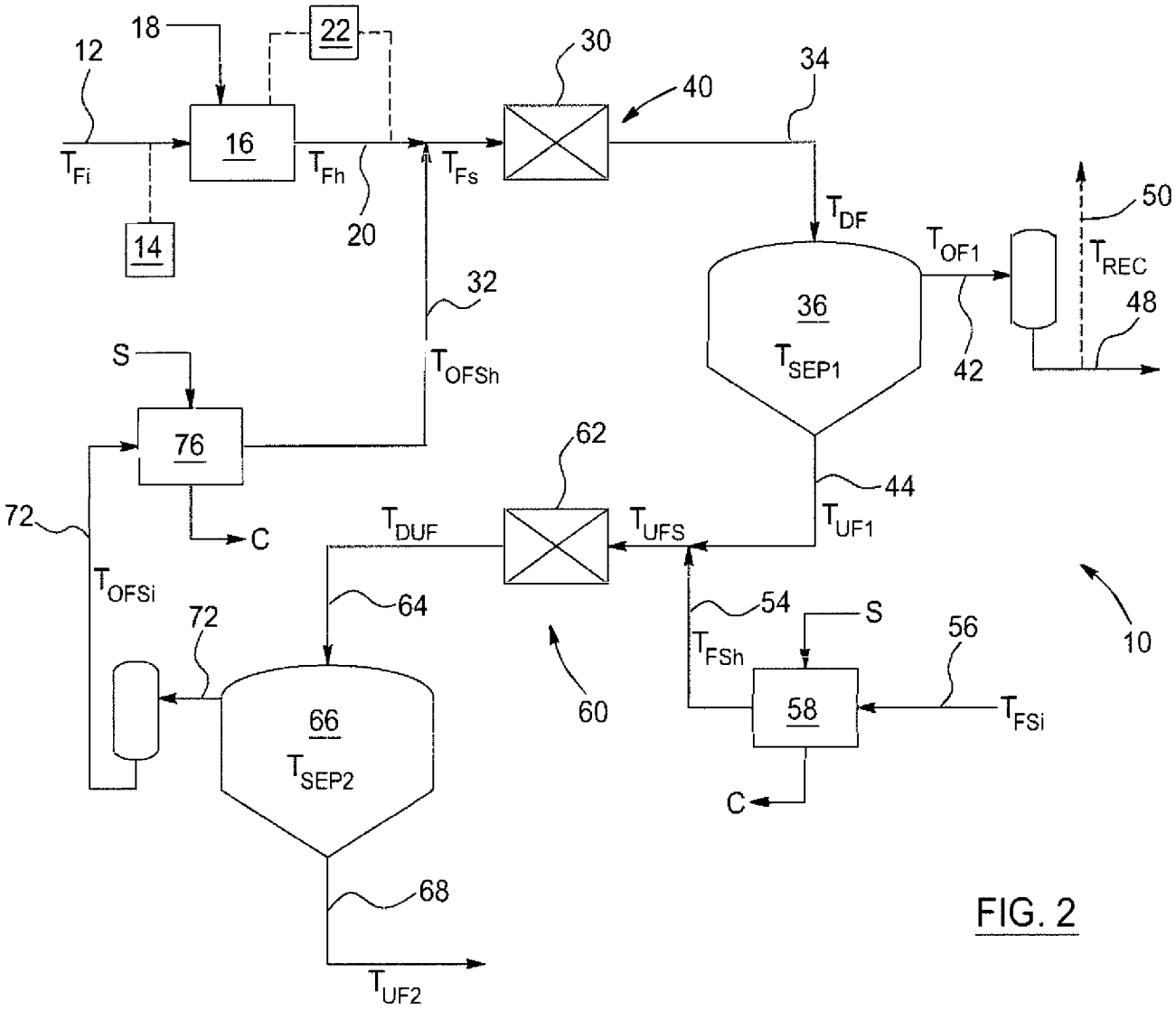
FIG. 2 is a schematic flow diagram according to an embodiment of the present invention.

Referring to FIG. 2, the following legend is presented and will be further discussed herein-below:

$T_{Fi}$ initial froth temperature
S steam
C condensate
$T_{Fh}$ heated froth temperature
$T_{OFSh}$ heated solvent containing overflow stream temperature
$T_{FS}$ initial froth-solvent temperature
$T_{DF}$ diluted bitumen froth temperature
$T_{SEP1}$ first stage separation vessel temperature
$T_{OF1}$ first stage overflow component temperature
$T_{UF1}$ first stage underflow component temperature
$T_{FSh}$ heated fresh solvent temperature
$T_{FSi}$ initial fresh solvent temperature
$T_{UFS}$ initial underflow-solvent temperature
$T_{DUF}$ diluted underflow temperature
$T_{SEP2}$ second stage separation vessel temperature
$T_{UF2}$ second stage underflow temperature
$T_{REC}$ diltbit recirculation stream temperature
$T_{OFSi}$ initial second stage overflow temperature In one embodiment of the present invention, the FSU temperature control method includes heating the froth to a froth mixing temperature that is below the flash temperature of the solvent and suitably high for adequate viscosity reduction to increase the froth droplet surface area and thus the mixing, breaking and dissolution of the froth droplets with the added solvent.

Since bitumen froth and solvent systems have particular and challenging flow, mixing and reaction characteristics, the temperature control methods of the present invention allow improved control and performance of both mixing and downstream separation performance. For instance, in a paraffinic froth treatment process, if the bitumen froth is at an inadequately high viscosity when paraffinic solvent is added, there are a number of inconveniences. First, due to the high viscosity of the froth, the solvent will have difficulty mixing throughout the froth volume, increasing the occurrence of unmixed parcels of bitumen upon introduction into the separation vessel and thus decreasing the bitumen recovery, decreasing the asphaltene precipitation and increasing solvent consumption due to inefficient use of the added solvent. Second, due to the high viscosity of the froth, the solvent will mix more gradually into the froth, causing more gradual formation of water/solids/precipitated-asphaltene aggregates at different times prior to introduction into the separation vessel, which can result in a non-uniform composition and variable aggregate structures distributed throughout the diluted froth feed causing unstable and decreased settling performance. Third, if the temperature control scheme for the FSU involves heating only the solvent stream or the solvent added froth stream or simply maintaining the separation vessels at a desired temperature, the benefits of initial rapid mixing of bitumen froth and solvent are diminished.

In addition, a PFT process may be designed to minimize solvent use and the conditions may be such that the optimum solvent-to-bitumen ratio (S/B) is between about 1.4 and about 2.0, preferably between about 1.6 and about 1.8. In the case of relatively low S/B, there is an increased importance of reducing and controlling the bitumen viscosity due to the relatively high content of the higher viscosity bitumen, i.e. bitumen, in the froth-solvent mixing.

In one optional aspect, the froth mixing temperature is controlled so as to be sufficiently high to form bitumen droplets having a maximum droplet size $d_{max}$ of about 100 □m. The $d_{max}$ is preferably in between about 100 □m and about 25 □m.

For a paraffinic froth treatment process, the froth mixing temperature in most cases is preferably above 60° C. The froth mixing temperature $T_{Fh}$ may be above 70° C., 90° C., about 100° C., above 110° C. and up to 120° C. for some cases.

The froth mixing temperature is preferably controlled to provide a bitumen viscosity between about 650 cP and about 100 cP.

In another aspect, the heating is performed such that the froth and first solvent containing streams have viscosities as close as possible to each other. For instance, the froth may be heated so that the difference in viscosity between the bitumen and the solvent addition stream is between about 100 cP and about 700 cP. The froth heating may be performed to achieve heated bitumen viscosity of at most about 700 cP higher than the solvent stream viscosity, preferably at most about 200 cP higher, still preferably at most about 150 cP higher.

In another embodiment, the solvent containing streams are trim heated to control the feed temperatures into the first and second stage separation vessels. Due to fluctuating bitumen froth qualities, achieving a consistent temperature of the diluted bitumen froth stream fed into the first stage separation vessel is challenging. By trim heating the second stage overflow stream 72 to produce a trim heated solvent containing stream 32, the diluted froth temperature can be maintained and, in turn, the first stage separation vessel 36 can be operated at a consistent stable temperature. The first stage underflow 44 as also combined with solvent and by trim heating the fresh solvent 56 to produce a trim heated second solvent containing stream 54, the diluted froth temperature can be maintained and, in turn, the second stage separation vessel 66 can be operated at a second consistent stable temperature. For instance, the first stage separation vessel 36 may be operated at a higher temperature, such as about 90° C. and the diluted froth 34 can be maintained at this temperature; and the second stage separation vessel 66 may be operated at a lower temperature, such as about 80° C., thereby reducing the heat requirements of the second trim heater 58 to maintain the second stage diluted feed stream 64 at about 80° C. Thus, the trim heating aspect of the temperature control strategy utilizes a balanced approach of trim heating both the first and second solvent containing streams and also trim heats the first solvent containing stream to a higher temperature for addition into the bitumen compared to the temperature of the second solvent containing stream. This provides improved separation performance and stability of the FSU 10 operation.

In one optional aspect, the solvent addition temperatures $T_{OFSh}$ and $T_{FSh}$ are adjusted according to the quality of the respective bitumen froth and first stage underflow component streams. This temperature adjustment is made in order to obtain enhanced mixing and maintain a constant temperature for both the diluted bitumen froth and the diluted first stage underflow component fed to the separation vessels.

The trim heating may be performed with a direct in-line addition of a heat source or with indirect contact with a heat source through a heat exchanger. Preferably, the trim heating is performed in heat exchangers using steam to trim heat the solvent and producing condensate.

In one aspect, the trim heating is performed such that the second solvent temperature $T_{FSh}$ is controlled above 50° C., preferably between about 60° C. and about 100° C. The second solvent temperature $T_{FSh}$ may also be controlled in such a way that the diluted first stage underflow component 64 has a viscosity between about 50 cP and about 650 cP.

In another aspect, the extent of trim heating depends on the second stage separating vessel temperature, the first stage underflow component quality and the source of the solvent. Bitumen froth quality often ranges from 50 wt % to 70 wt % of bitumen and the key components which are bitumen, water and mineral differ significantly in heat capacity. The adjustment of the first solvent temperature $T_{OFSh}$ and second solvent temperature $T_{FSh}$ may be particularly controlled in accordance with the compositions of the froth or first stage underflow to achieve stable temperature, viscosity and density characteristics of the diluted streams in order to enhance the settling of asphaltene precipitates and aggregates The simultaneous control of the temperature before both the first stage separation and the second stage separation also ensures enhanced stability and separation performance of the froth treatment, which is also beneficial for downstream unit operations, such as solvent recovery operation and tailings solvent recovery operation.

Referring to FIGS. 1 and 2, there is one corresponding solvent containing stream with temperatures $T_{OFSh}$ and $T_{FSh}$ for addition into each process stream 20 and 44. The temperature of the heated bitumen froth 20 can thus be controlled so as to achieve adequate mixing with a single addition point of the solvent containing stream 32.

Figure 3:
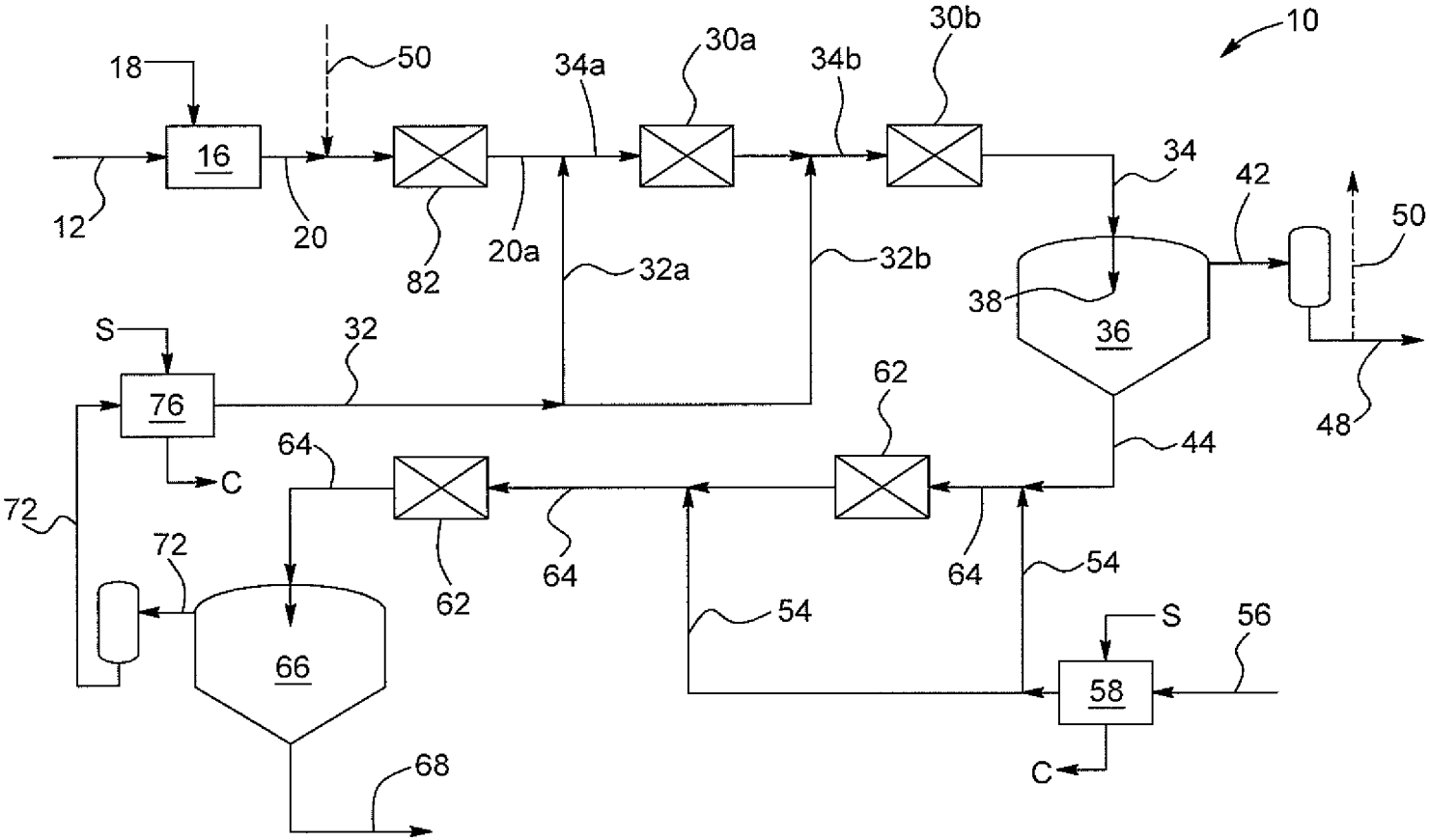
FIG. 3 is a schematic flow diagram according to another embodiment of the present invention.

Referring to FIG. 3, the FSU may include multiple addition points of two solvent containing streams 32*a* and 32*b* into the bitumen froth and may also have an additional stream that is combined with the bitumen froth prior to the first stage separation vessel 36. More particularly, a first solvent stream 32*a* may be added to the heated bitumen froth 20*a* and the resulting partially diluted bitumen froth 34*a* may be subjected to mixing in mixer 30*a*. Next, a second solvent stream 32*b* may be added to the partially diluted bitumen froth 34*a* and the resulting froth-solvent stream 34*b* may be subjected to mixing in second mixer 30*b* to ultimately produce the diluted froth 34 for introduction into the first stage separation vessel 36. Preferably, the first solvent stream 32*a* is added in an amount to provide an S/B in the partially diluted bitumen froth 34*a* below the asphaltene precipitation threshold thereby largely avoiding formation of water/solids/precipitated-asphaltene aggregates in the partially diluted bitumen froth 34*a* which has thoroughly mixed solvent throughout. The first solvent stream 32*a* flow is thus controlled in accordance with the bitumen content of the heated froth 20*a* to ensure a controlled S/B. The second solvent stream 32*b* is then added in an amount to exceed the asphaltene precipitation threshold and thus induce asphaltene precipitation and formation of water/solids/precipitated-asphaltene aggregates in the second froth-solvent stream 34*b* and the fully mixed diluted froth feed stream 34. In addition to multiple staged addition of solvent, the FSU may also include another bitumen containing stream added into the bitumen froth to help heat and/or reduce the viscosity of the bitumen froth prior to the addition of solvent. In one aspect, the additional bitumen containing stream may be the diltbit recirculation stream 50. This diltbit recirculation stream 50 may be added to the bitumen froth before or after heating in heater 16. The diltbit-froth mixture may be subjected to mixing in an additional mixer 82 to produce heated bitumen froth stream 20*a*. However, it should be noted that the initial heating and temperature control of the bitumen froth enables advantageous mixing with any subsequent stream including viscosity reducing streams, e.g. stream 50, and solvent containing streams, e.g. streams 32*a* and 32*b*, facilitating stable and well-performing separation.

In one preferred aspect, the first solvent-containing stream 32 comprises at least a portion of the second stage overflow component 72. As illustrated in FIG. 1, the second stage overflow component 72 may be completely recycled and heated to form the first solvent-containing stream 32. In this configuration, the operating temperatures of the first stage separation and the second stage separation interact. Due to retention volumes in the separating vessels 36, 66, this interaction is delayed and permits gradual temperature adjustments over time. The first solvent temperature $T_{OFSh}$ and second solvent temperature $T_{FSh}$ are preferably each controlled with a variation of +/−2° C. The second solvent-containing stream 54 may be essentially solvent such as a recycled solvent coming from upstream or downstream operations, preferably from a SRU and a TSRU. In one aspect, the intent of the solvent trim heaters 58, 76 is to minimize temperature variations in the vessels 36, 66 for promoting operational stability and separation performance of the whole process. Indeed, the gravity separation of components in the vessels 36, 66 depends on both density and viscosity differentials which are affected by temperature.

In another optional aspect, avoiding undesirable temperature variations in the first stage separating vessel 36 and the second stage separating vessel 66 may include controlling the bitumen froth temperature $T_{Fh}$ higher than the first solvent temperature $T_{OFSh}$. In fact, in one aspect, to achieve the same diluted froth temperature $T_{DF}$, it is preferable to devote the heating energy to the bitumen froth 12 to obtain a hotter heated bitumen froth 20 than to the first solvent containing stream 32. This heating methodology provides improved utilization of heat energy by reducing the viscosity of the bitumen for better mixing with the same feed temperature outcome, which translates into improved settling stability and performance and efficient utilization of solvent.

In another aspect, the heated froth temperature $T_{Fh}$ is at least 70° C. and more preferably ranges between about 75° C. and 95° C. Furthermore, the addition of solvent under controlled temperature also helps to ensure maximum mixing with the bitumen froth. In another aspect, the difference between the heated froth temperature $T_{Fh}$ and the first solvent containing temperature $T_{OFSh}$ may be controlled between about 2° C. and 20° C. with $T_{Fh}>T_{OFSh}$.

In a further optional aspect, the second stage separating vessel 66 has an operating temperature lower than that of the first stage separating vessel 36, i.e. $T_{SEP1}>T_{SEP2}$. In this aspect, higher temperatures are viewed as less important in the second stage separation vessel partly since separation parameters due the high S/B are easier to achieve in the second stage than the first.

In another aspect, the second stage underflow is controlled so that the solvent diluted tailings 68 are at a temperature $T_{UF2}$ sufficient to facilitate downstream TSRU operation. The $T_{UF2}$ may be at least about 60° C. and more preferably range between about 70° C. and about 10° C. depending on upstream and downstream temperatures and other unit operating conditions, notably pressure.

In another aspect, the difference between $T_{UF1}$ and $T_{FSh}$ may be controlled between about 2° C. and about 15° C.

In other optional aspects, the temperatures may be maintained sufficiently high to delay the onset of asphaltene precipitation and allow lower S/B. Diluted froth temperatures about 120° C. up to about 130° C. may be achieved with direct steam injection to enable advantageous vessel sizing, mixing and separation performance.

In another aspect, the present invention allows reduction of heating of make-up solvent. The first stage underflow contains an amount of solvent and little bitumen such that it is much easier to mix with make-up solvent compared to the bitumen froth. The viscosity of the first stage underflow is much lower than the bitumen froth and the temperature required to achieve effective mixing with the make-up solvent is thus not as high. The second solvent containing stream and the second stage separation vessel may thus be at lower temperatures. A constraint on the second stage separation vessel is to have sufficiently high temperature so as to produce a solvent diluted tailings hot enough to flash in the downstream TSRU. The trim heater for heating the second stage overflow may be configured to tailor the first solvent containing temperature $T_{OFSh}$ to froth quality and maintain constant temperature of the separation, not to heat the froth necessarily.

In another optional aspect, the process includes a step of chemically modifying the viscosity of the bitumen froth. A viscosity modifier may be added to the bitumen froth before or after or in between two heating steps. For instance, referring to FIG. 3, a viscosity modifier may be injected into the bitumen froth 12 downstream of the heater 16 and upstream of the additional mixer 82, in this illustrated case as a recirculated diluted bitumen stream 50 from the first stage separation vessel 36. It should be noted, however, that the recirculated diluted bitumen stream 50 may be added upstream or downstream of any one of mixers 82, 30*a* or 30*b* or solvent streams 32*a* or 32*b*. Preferably, the recirculated diluted bitumen stream 50 is injected into the heated bitumen froth 20 downstream of the heater 16, since the viscosity modifier still needs to be mixable into the bitumen froth stream to modify its viscosity. Thus, addition into the unheated bitumen froth 12 would be less advantageous since the viscosity modifier would not be able to mix as effectively into the froth stream 12. There may also be multiple addition points of the viscosity modifier prior to introduction of the diluted bitumen froth 34 into the separation vessel 36. The viscosity modifier may be derived froth the froth treatment process itself, being a recirculated stream such as recirculated diluted bitumen stream 50; obtained from another oil sands operations such as upgrading or in situ recovery; or provided as a new chemical addition stream, depending on the type of viscosity modifier and available process streams. The viscosity modifier may comprise one or more families of chemicals including naphthenic diluent, paraffinic diluent, light hydrocarbons, other chemical additives, and the like. The viscosity modifier may also be selected to further reduce the viscosity of the froth in response to an increase in temperature. For the case of a paraffinic froth treatment process, the viscosity modifier may be a pre-blending amount of paraffinic solvent which may be a recirculated stream containing paraffinic solvent such as the recirculated diluted bitumen stream 50. Such a pre-blending paraffinic viscosity modifier is preferably added to the froth in an amount below the precipitation concentration to avoid precipitating asphaltenes and thus emphasise the viscosity modification functionality.

In another optional aspect, the solvent containing streams are added and blended in two stages at different S/B. The bitumen froth and first stage underflow streams are thus conditioned according to the characteristics of each stream to add the solvent in the desired amount.

As mentioned herein-above, the bitumen froth is heated to a temperature bellow the flash temperature of the solvent to be added. Thus, this temperature will depend on the pressure of the system as well as the type of solvent being used and its vapour pressure at the given temperature. A light solvent such as butane flashes at lower temperatures compared to heavier solvents such as hexane and heptane. For new designs and operationally retrofitting existing systems, in order to increase the upper temperature limit a solvent with a higher flash temperature could be used or the pressure of the system maybe increased. Increasing the pressure of the system, including the separation vessel, may be relatively expensive especially since vapour pressure increases are exponential with respect to rises in temperature. By way of example, for a design pressure of about 1000 kPaa the upper temperature limit constrained by the vapour pressure of pentane as solvent would be about 112° C. and for a design pressure of about 750 kPaa the upper temperature limit constrained by the vapour pressure of pentane as solvent would be about 99° C. In a preferred aspect, the upper temperature limit is lower than the flashing temperature of the solvent by at least 5° C., preferably by at least about 10° C. In another aspect, the hydraulic liquid load in the separation vessel is also taken into consideration and thus the pressure is provided accordingly lower. In a design with a pressure of about 750 kPaa, the temperature may be preferably up to about 100° C. and higher temperatures up to 120° C. for example could be used with appropriate pressure containment conditions.

EXAMPLES, ESTIMATES & CALCULATIONS

I. Temperature Comparison Calculation Examples

Calculation and estimate testing were performed to assess the relative effect of increased froth temperature on blending froth with solvent where initial blending of bitumen froth and solvent first breaks the bitumen froth to drops which aids solvent dissolving into bitumen. This included estimation of the relative effect of increased froth temperature on mixing. In the initial mixing and blending of bitumen froth and solvent, it was considered that the bitumen (assume controlling) needs to break down to drops to permit the solvent to dissolve the matrix.

Drop size equations incorporating terms for the viscous resistance to drop breakup are identified in Equation 7-27 of "*Handbook of Industrial Mixing: Science and Practice*", E. Paul et al., John Wiley & Sons, 2004:

$$d_{max} = K_1\left(\frac{\sigma}{\rho_c}\right)^{0.6}\left(\frac{\rho_c}{\rho_d}\right)^{0.2}\varepsilon^{-0.4}(1+Vi)$$

Where:

$d_{max}$=maximum droplet size $K_1$=constant for specific mixer (in the order of 1.0: refer to equation 7-24)

$\sigma$=surface tension $\rho_c$=density of the continuous phase (assume in this case hydrocarbon due to volume)

$\rho_d$=density of viscous dispersed phase: bitumen in froth assumed as controlling $\varepsilon$=energy intensity=$(\Delta PV)/(\rho L)$ $\Delta P$=pressure drop V=velocity L=Length Vi=viscosity number=$u_d V/\sigma(\rho_c/\rho_d)^{0.5}$ $u_d$=Dispersed phase viscosity/or elongational viscosity=Newton shear viscosity*3

| Stream | Froth | $2^{ND}$ Stage O/F | 1st stage Feed | 1stage O/F |
|---|---|---|---|---|
| Temperature C. | 82.5 | 80 | 80.1 | 80 |
| Density kg/m$^3$ | 1032 | 589 | 759 | 673 |
| Viscosity cP | 1815.82 | 0.16 | 1.55 | 0.74 |
| Bitumen wt % | 52.48 | 3.26 | 28.92 | 35.50 |
| Solvent wt % | 0.00 | 96.64 | 46.25 | 64.36 |

In case 1, two situations were considered: bitumen froth at 70° C. and at 90° C., each blended in a 24 NPS mixer pipe with 2nd stage O/F to froth settler vessel at 80° C.

| | | |
|---|---|---|
| D = Pipe ID m | 0.575 | |
| V = Velocity m/s | 3.42 | based on bulk flow volume |
| Empty pipe shear rate G' ($S^{-1}$) | 47.5 | where G' = 8V/D Eq 7-21 |
| Reynolds Number | 1785 | Laminar continuous hydrocarbon phase |
| friction factor f | 0.0090 | Laminar = 16/Nre |
| $\Delta P$ = pressure drop/meter | 30.8 | empty pipe kPa/m = 4 * f* $\Delta V$ 2/(D *2)/1000 |

| Bitumen Phase | Situation 1 | Situation 2 | |
|---|---|---|---|
| Temperature ° C. | 70 | 90 | |
| Density kg/m$^3$ | 987.4 | 975.4 | Bitumen density at temperature |
| Viscosity (cP) | 626 | 176 | Bitumen viscosity at temperature |
| $u_d$ | 1878 | 529 | Dispersed phase viscosity |
| $\sigma$ (mN/m) | 13 | 11 | s = surface tension: AOSTRA 1989 FIG. 5: 1 g/L NaCl |

Calculation of Viscosity Number

| | Situation 1 | Situation 2 | |
|---|---|---|---|
| $\rho_c$ (kg/m3) | 673 | 673 | $\rho_c$ = density of the continous phase |
| V (m/s) | 3.42 | 3.42 | velocity based on bulk flow |
| Vi | 407 | 136 | Vi = viscosity number |

Calculation of Energy Intensity: Based on Empty Pipe

| | Situation 1 | Situation 2 | |
|---|---|---|---|
| ΔP/L | 30.8 | 30.8 | Empty pipe/bulk stream properties |
| ε | 0.139 | 0.139 | Same end mixture. |
| $K_1$ | 1.0 | 1.0 | Constant in the order of 1.0 |

Calculation of $d_{max}$ Per Equation Defined Above

| | Situation 1 | Situation 2 |
|---|---|---|
| $d_{max}$ | 78.1 | 23.8 |
| Surface area/drop | 19153 | 1783 |
| Volume/drop | 249253 | 7082 |
| Drops per unit volume | 1 | 35 |
| Net surface area | 19153 | 62767 |

In conclusion, the reduced viscosity by increasing froth temperature 20° C. improves blending of bitumen froth and solvent by smaller droplets or increased surface area.

| | |
|---|---|
| $\Delta d_{max}$ | 30.5% |
| ΔSurface Area | 3.28 |

II. Example Froth Properties

Figure 4:
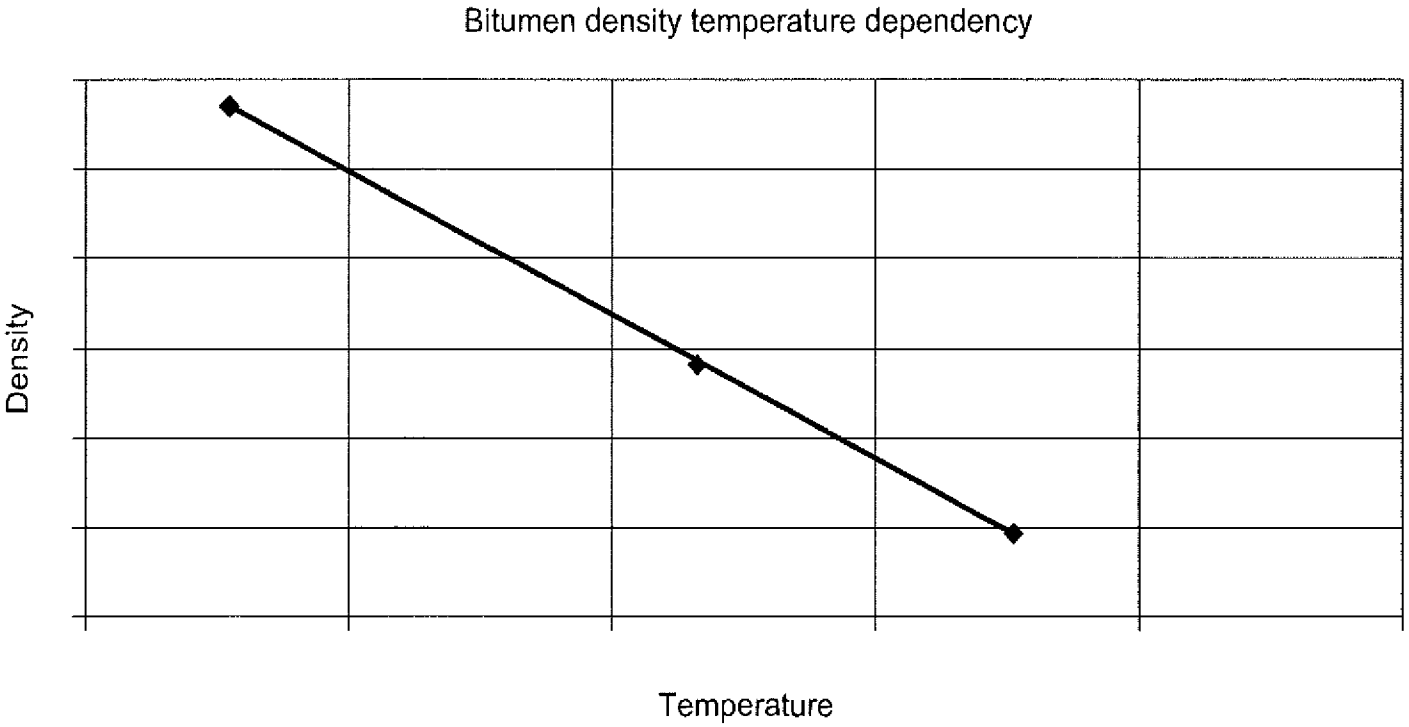
FIG. 4 is a graph of bitumen density versus temperature.
Figure 5:
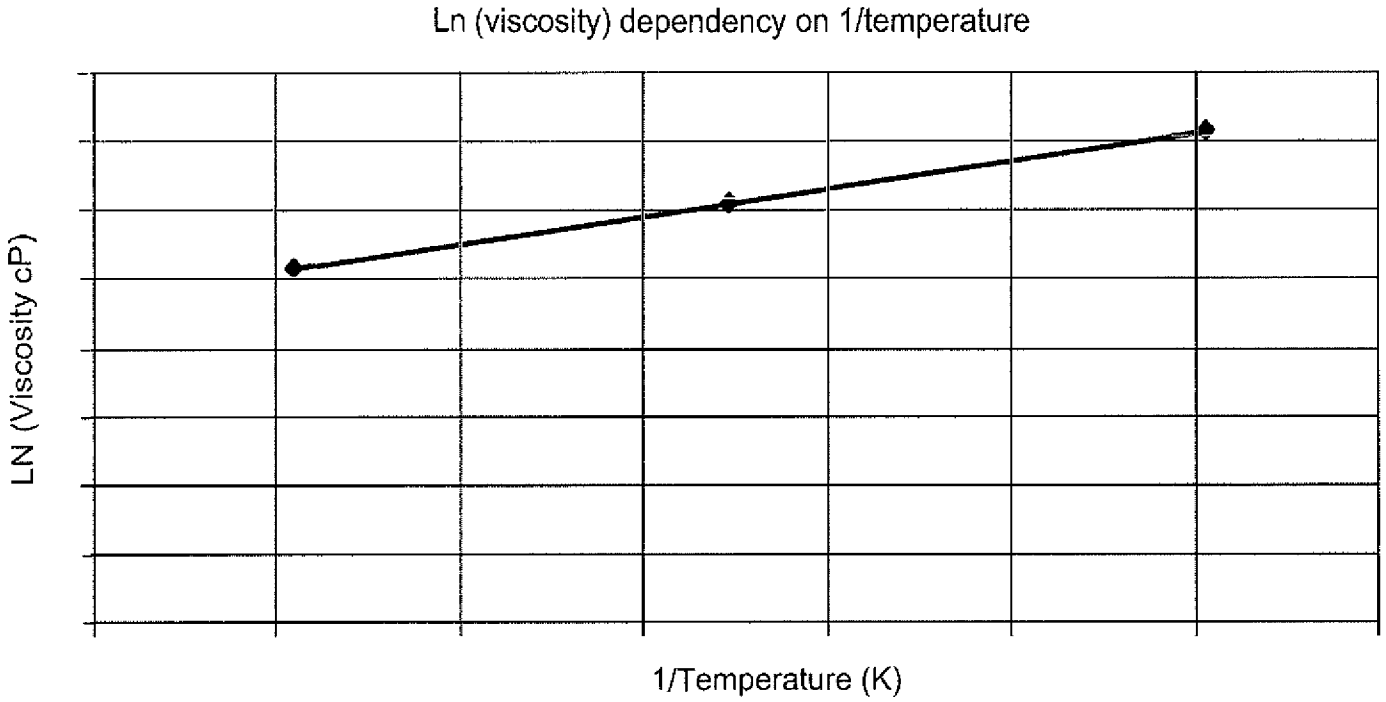
FIG. 5 is a graph of the natural logarithm of viscosity versus temperature of bitumen.

Density and viscosity of raw bitumen related to temperature is presented in FIGS. 4 and 5.

Density

Density (SG) for hydrocarbons reduces as temperature increases approximately linearly except when approaching critical temperature. For an exemplary range of interest, consider up to 130° C., bitumen is well below critical temperature. Density of raw bitumen correlates as follows: Density (g/cm3) @ temp=−0.0006*(Temp in K or C+273)+1.1932. See FIG. 4.

Viscosity

Viscosity of raw bitumen generally follows Andrade equation (from Perry's Handbook, 6th Edition). In $(h_L)$=A+B/T, where $h_L$ is the liquid viscosity in centipoises (cP), cP=mPa·s, T is the temperature in K, C+273; In $(h_L)$=A+B/T=16.56-7888.8/T (K).

Bitumen viscosity dependency on temperature:

$h_L = e^{(-16.56+7888.8/T)}$

See FIG. 5.

II. Comparative Conceptual Examples

In order to illustrate certain aspects and embodiments of the present invention, comparative conceptual examples are presented herein-below. The terms used for the various stream temperatures are illustrated in FIG. 2.

Comparative Example A

A1: High temperature bitumen froth heating $T_{Fi}$=65° C.
$T_{Fh}$=90° C.
Froth bitumen $d_{max}$=23.8 □m
Froth bitumen viscosity=176 cP
Froth bitumen density=975.5 kg/m$^3$
$T_{OFSi}$=75° C.
$T_{OFSh}$=80° C.
$T_{DF}$=87.5° C.
$T_{SEP1}$=87.5° C.
$T_{UF1}$=85° C.
$T_{FSi}$=60° C.
$T_{FSh}$=75° C.
$T_{DUF}$=80° C.
$T_{SEP2}$=80° C.

A2: Solvent heating for temperature control $T_{Fi}$=$T_{Fh}$=65° C.
Froth bitumen $d_{max}$>78.1 □m
Froth bitumen viscosity>626 cP
Froth bitumen density>987.4 kg/m$^3$
$T_{OFSi}$=75° C.
$T_{OFSh}$=110° C.
$T_{DF}$=87.5° C.
$T_{SEP1}$=87.5° C.
$T_{UF1}$=85° C.
$T_{FSi}$=60° C.
$T_{FSh}$=75° C.
$T_{DUF}$=80° C.
$T_{SEP2}$=80° C.

Comparing examples A1 and A2, both first and second stage separation vessels as well as several process streams are operated at identical temperatures. However, example A1 imparts heating energy to the bitumen froth stream resulting in low viscosity and superior froth-solvent mixing characteristics compared to example A2.

Comparative Example B

B1: High temperature bitumen froth heating with low solvent heating $T_{Fi}$=65° C.
$T_{Fh}$=95° C.
Froth bitumen $d_{max}$<23.8 □m
Froth bitumen viscosity<176 cP
Froth bitumen density<975.5 kg/m$^3$
$T_{OFSi}$=75° C.
$T_{OFSh}$=approximately 75° C. with optional trim heating 1-2° C.
$T_{DF}$=85° C.
$T_{SEP1}$=85° C.
$T_{UF1}$=82.5° C.
$T_{FSi}$=60° C.
$T_{FSh}$=approximately 60° C. with optional trim heating 1-2° C.
$T_{DUF}$=75° C.
$T_{SEP2}$=75° C.

B2: Solvent heating for temperature control $T_{Fi}$=65° C.
$T_{Fh}$=70° C.
Froth bitumen $d_{max}$=78.1 □m
Froth bitumen viscosity=626 cP
Froth bitumen density=987.4 kg/m$^3$
$T_{OFSi}$=75° C.
$T_{OFSh}$=100° C.
$T_{DF}$=85° C.

$T_{SEP1}$=85° C.
$T_{UF1}$=82.5° C.
$T_{FSi}$=$T_{FSh}$=60° C.
$T_{DUF}$=75° C.
$T_{SEP2}$=75° C.

B3: Fresh solvent heating for temperature control
$T_{Fi}$=$T_{Fh}$=65° C.
Froth bitumen $d_{max}$<78.1 □m
Froth bitumen viscosity<626 cP
Froth bitumen density<987.4 kg/m$^3$
$T_{OFSi}$=80° C.
$T_{DF}$=70° C.
$T_{SEP1}$=70° C.
$T_{UF1}$=67.5° C.
$T_{FSi}$=60° C.
$T_{FSh}$=90° C.
$T_{DUF}$=80° C.
$T_{SEP2}$=80° C.

Comparing examples B1 and B2, both first and second stage separation vessels as well as several process streams are operated at identical temperatures. However, example B1 imparts heating energy to the bitumen froth stream resulting in low viscosity and superior froth-solvent mixing characteristics compared to example B2.

Comparing examples B1 and B3, the temperature control strategy is quite different particularly insofar as in B1 the first stage separation vessel is hotter that the second and in B3 the second stage separation vessel is hotter than the first. Example B1 has the marked advantage of lowering the viscosity of the bitumen froth stream for superior froth-solvent mixing characteristics compared to example B3.

Indeed, the same amount of heat energy can be imparted in different ways to different streams to achieve the same operational temperature in the separation vessels, e.g. comparative examples A1 versus A2 and B1 versus B2. In embodiments of the present invention, the heat energy is used advantageously to emphasize bitumen froth heating to achieve improved solvent-froth mixing and separation performance particularly in the first stage separation vessel.

It is worth mentioning that throughout the preceding description when the article "a" is used to introduce an element it does not have the meaning of "only one" it rather means of "one or more". For instance, the apparatus according to the invention can be provided with two or more separation vessels, etc. without departing from the scope of the present invention.

While the invention is described in conjunction with example embodiments, it will be understood that it is not intended to limit the scope of the invention to such embodiments. On the contrary, it is intended to cover all alternatives, modifications and equivalents as may be included as defined by the present description. The objects, advantages and other features of the present invention will become more apparent and be better understood upon reading of the following detailed description of the invention, given with reference to the accompanying drawings.

The invention claimed is:

1. A process for treating a bitumen froth to produce a diluted bitumen component and a solvent diluted tailings component, comprising:

adding a first solvent containing stream to the bitumen froth to produce a diluted bitumen froth;

separating the diluted bitumen froth into a first stage overflow component comprising the diluted bitumen component and a first stage underflow component;

adding a second solvent containing stream to the first stage underflow component to produce a diluted first stage underflow component; and separating the diluted first stage underflow component into a second stage overflow component and a second stage underflow component comprising the diluted tailings component;

wherein the process further comprises adding a chemical viscosity modifier that is derived from the diluted bitumen component, to the bitumen froth, and wherein the first and second solvent containing streams comprise paraffinic solvents.

2. The process of claim 1, wherein the chemical viscosity modifier consists of a recirculated diluted bitumen stream that is a portion of the first stage overflow component.

3. The process of claim 1, wherein the chemical viscosity modifier is added to the froth in an amount below asphaltene precipitation concentration.

4. The process of claim 1, wherein the chemical viscosity modifier consists of a recirculated diluted bitumen stream that is a portion of the first stage overflow component and the chemical viscosity modifier is added to the froth in an amount below asphaltene precipitation concentration.

5. The process of claim 1, wherein the chemical viscosity modifier is added to the bitumen froth before addition of the first solvent containing stream to the bitumen froth.

6. The process of claim 2, wherein the chemical viscosity modifier is added to the bitumen froth before addition of the first solvent containing stream to the bitumen froth.

7. The process of claim 3, wherein the chemical viscosity modifier is added to the bitumen froth before addition of the first solvent containing stream to the bitumen froth.

8. The process of claim 4, wherein the chemical viscosity modifier is added to the bitumen froth before addition of the first solvent containing stream to the bitumen froth.

9. The process of claim 5, wherein addition of the chemical viscosity modifier to the bitumen froth produces a bitumen froth with a reduced viscosity to improve mixing of the first solvent containing stream and the froth and produce a diluted froth that is fully mixed prior to the separation step.

10. The process of claim 1, further comprising heating the bitumen froth to produce a heated bitumen froth, before mixing with the first solvent containing stream.

11. The process of claim 2, further comprising heating the bitumen froth to produce a heated bitumen froth, before mixing with the first solvent containing stream.

12. The process of claim 5, further comprising heating the bitumen froth to produce a heated bitumen froth, before mixing with the first solvent containing stream.

13. The process of claim 9, further comprising heating the bitumen froth to produce a heated bitumen froth, before mixing with the first solvent containing stream.

14. The process of claim 10, wherein the chemical viscosity modifier is added to the heated bitumen froth.

15. The process of claim 14, wherein the heating is conducted by direct steam injection.

16. The process of claim 10, wherein the heated bitumen froth has a temperature ranging from about 75° C. to about 95° C.

17. The process of claim 11, wherein the heated bitumen froth has a temperature ranging from about 75° C. to about 95° C.

18. The process of claim 14, wherein the heated bitumen froth has a temperature ranging from about 75° C. to about 95° C.

19. The process of claim 1, further comprising heating the bitumen froth to produce a heated bitumen froth, before mixing with the first solvent containing stream, and wherein the chemical viscosity modifier consists of a recirculated diluted bitumen stream that is a portion of the first stage overflow component, and the chemical viscosity modifier is added to the heated froth in an amount below asphaltene precipitation concentration.

20. The process of claim 1, wherein the bitumen froth has a bitumen content between about 40 wt % and about 75 wt %.

* * * * *